US007343889B2

(12) United States Patent
Tooyama et al.

(10) Patent No.: US 7,343,889 B2
(45) Date of Patent: Mar. 18, 2008

(54) CAM ANGLE SENSOR MOUNTING STRUCTURE

(75) Inventors: Hideaki Tooyama, Yokohama (JP); Shin Nomura, Yokohama (JP); Hironao Netsu, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 9 days.

(21) Appl. No.: 11/491,903

(22) Filed: Jul. 25, 2006

(65) Prior Publication Data

US 2007/0017282 A1 Jan. 25, 2007

(30) Foreign Application Priority Data

Jul. 25, 2005 (JP) ..... 2005-213576

(51) Int. Cl.
*F01M 9/10* (2006.01)

(52) U.S. Cl. ..... 123/90.38; 123/195 A; 73/118.1

(58) Field of Classification Search ..... 123/195 A, 123/90.38; 73/118.1
See application file for complete search history.

(56) References Cited

U.S. PATENT DOCUMENTS

2001/0042527 A1* 11/2001 Uchida ..... 123/90.15

FOREIGN PATENT DOCUMENTS

JP 3431505 B2 5/2003
JP 2005-113850 A 4/2005

* cited by examiner

*Primary Examiner*—Hieu T. Vo
*Assistant Examiner*—Katrina B. Harris
(74) *Attorney, Agent, or Firm*—Global IP Counselors, LLP

(57) ABSTRACT

A cam angle mounting structure includes a cylinder head, a sensor bracket and a head cover. The cylinder head is configured and arranged to rotatably support a camshaft. The sensor bracket is configured and arranged to support a cam angle sensor. The sensor bracket is mounted on the cylinder head with the sensor bracket contacting the cylinder head. The head cover is non-rigidly mounted on the cylinder head and the sensor bracket via at least one gasket to cover a top opening of the cylinder head with a space being formed around the at least one gasket between the head cover and the cylinder head and between the head cover and the sensor bracket.

11 Claims, 8 Drawing Sheets

CAM ANGLE SENSOR MOUNTING STRUCTURE

CROSS-REFERENCE TO RELATED APPLICATIONS

This application claims priority under 35 U.S.C. § 119 to Japanese Patent Application No. 2005-213576. The entire disclosure of Japanese Patent Application No. 2005-213576 is hereby incorporated herein by reference.

BACKGROUND OF THE INVENTION

1. Field of the Invention

The present invention relates to a mounting structure of a cam angle sensor configured and arranged to detect rotation angle of a camshaft of an internal combustion engine.

2. Background Information

An internal combustion engine is usually provided with cam angle sensors to detect rotation angles (positions) of camshafts of intake and exhaust valves. The cam angle sensor is disposed in a radial outer direction of a signal plate, which serves as a detection part, provided at a rear end of the camshaft and configured and arranged to detect projections and grooves formed in the signal plate. Japanese Patent No. 3,431,505 discloses a cam angle mounting structure in which a cam angle sensor is mounted on a cylinder head of the engine. Japanese Laid-Open Patent Publication No. 2005-113850 discloses a cam angle mounting structure in which a cam angle sensor is mounted on a head upper disposed between a head cover and a cylinder head. A cam angle sensor may be mounted on a cam bracket that rotatably supports a camshaft with a cylinder head, or on a head cover that covers a top surface opening of a cylinder head.

In view of the above, it will be apparent to those skilled in the art from this disclosure that there exists a need for an improved cam angle sensor mounting structure for internal combustion engine. This invention addresses this need in the art as well as other needs, which will become apparent to those skilled in the art from this disclosure.

SUMMARY OF THE INVENTION

When a cam angle sensor is mounted on a cylinder head, the cam angle sensor and its mounting position is inevitably disposed in a region below the transverse side of the signal plate, that is, a lower region in the transverse side of the cylinder head due to the presence of a head cover in an upper portion of the cylinder head, which covers opening on the top surface of the cylinder head. In recent years, there has been particular demand for more compact internal combustion engines, which has made it very difficult to ensure mounting space for a cam angle sensor in the lower region to the transverse side of the cylinder head as described above. Also, when the cam angle sensor is mounted from downward to upward inclined direction, there is concern of a sensing part being fouled by foreign matter such as dust and oil, and dirt damage since the sensing part is typically located at a tip portion of the cam angle sensor and faces upward.

On the other hand, when the cam angle sensor is mounted on the head cover, the head cover is required to be made of metal, for example aluminum alloy, in order to ensure the rigidity for supporting the cam angle sensor, which is disadvantageous from the perspective of weight, cost and design freedom compared to a resin head cover. Furthermore, the cam angle sensor mounting structure is required to be a rigid structure (for example, semi-floating structure) to solidly attach the head cover to the cylinder head made by, for example, an aluminum die-casting so as not to reduce sensor reading precision due to engine vibration and the like. Therefore, weight, cost, and noise are disadvantageously affected compared to when a resin head cover is used that can take a soft mount such as, for example, a full floating structure.

When the cam angle sensor is mounted on a cam bracket, there is concern that reading precision of the cam angle sensor will be reduced due to deformation caused by the relatively large load acting on the cam bracket from the cam shaft and a front (or rear) cover. Thus, the cam bracket is not advantageous as a mounting part of the cam angle sensor.

In view of these problems, one object of the present invention is to provide an improved cam angle sensor mounting structure for internal combustion engine that attains both a compact and lightweight head cover, and a cam angle sensor of improved and high level precision.

In order to achieve the above mentioned object and other objects of the present invention, a cam angle sensor mounting structure includes a cylinder head, a sensor bracket and a head cover. The cylinder head is configured and arranged to rotatably support a camshaft. The sensor bracket is configured and arranged to support a cam angle sensor. The sensor bracket is mounted on the cylinder head with the sensor bracket contacting the cylinder head. The head cover is non-rigidly mounted on the cylinder head and the sensor bracket via at least one gasket to cover a top opening of the cylinder head with a space being formed around the at least one gasket between the head cover and the cylinder head and between the head cover and the sensor bracket.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 6:
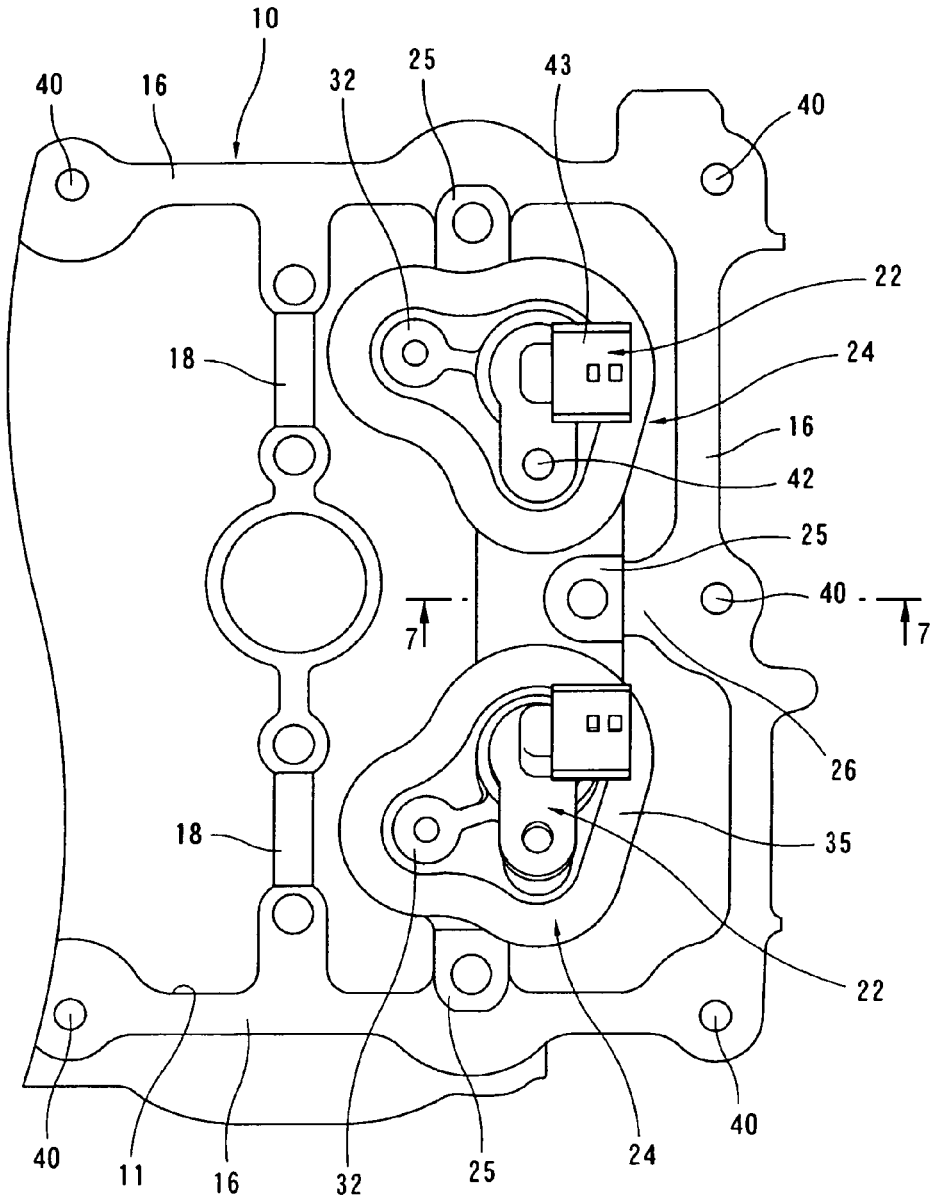
FIG. 6 is a partial top plan view of the cylinder head of the internal combustion engine with the cam angle sensor mounting structure in accordance with the embodiment of the present invention illustrating a state in which the head cover is removed.
Figure 7:
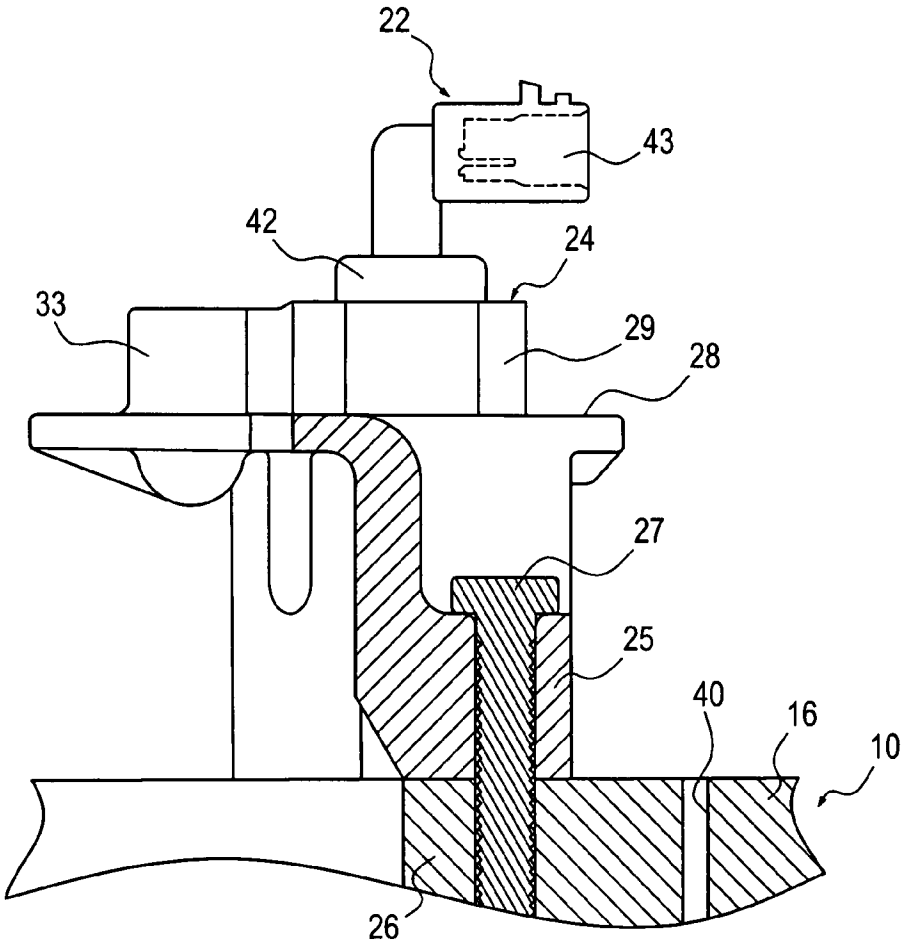
FIG. 7 is a partial cross sectional view of the internal combustion engine with the cam angle sensor mounting structure in accordance with the embodiment of the present invention taken along a section line 7-7 of FIG. 6.
Figure 8:
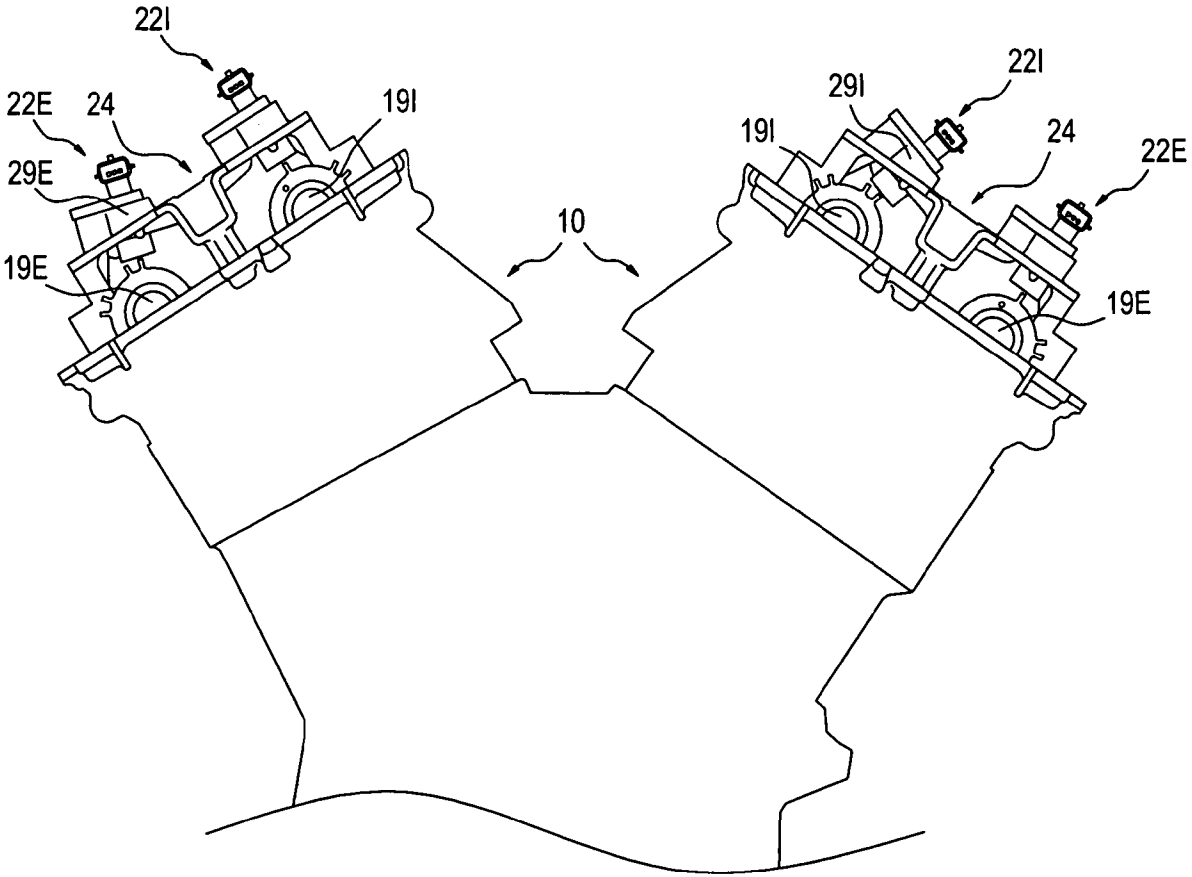
FIG. 8 is a rear elevational view of a V-type engine with each bank having the cam angle sensor mounting structure in accordance with the embodiment of the present invention illustrating a state in which the head covers are removed.

FIGS. 1 to 8 show an internal combustion engine with a cam angle sensor mounting structure in accordance with one embodiment of the present invention. The internal combustion engine is, for example, a V-type 6-cylinder engine as shown in FIG. 8 with the intake system (INT side) on the inner side of banks, and the exhaust system (EXH side) on the outer side of the banks. The internal combustion engine is preferably transversely installed in an engine room at the front of a vehicle. As used herein, the terms "up" and "down" are used with respect to up-down direction of cylinders (i.e., up-down direction of a cylinder head) in each bank, and the terms "front" and "rear" are used with respect to front-rear direction of the cylinder array direction in the engine. Structural elements on the intake side are designated by "I" following the reference number, and structural elements on the exhaust side are designated by "E" following the reference number when necessary.

Figure 1:
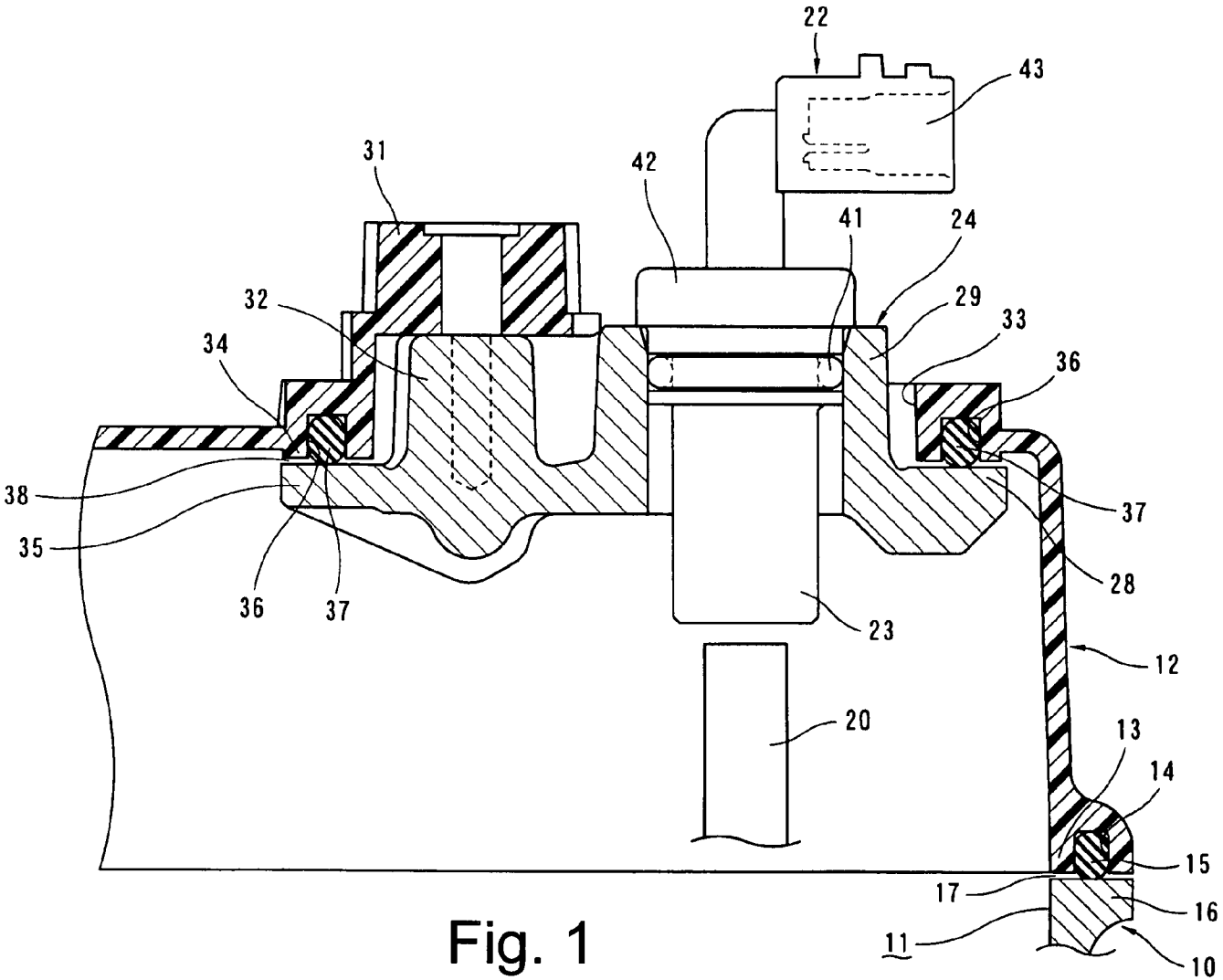
FIG. 1 is a partial cross sectional view of an internal combustion engine with a cam angle sensor mounting structure in accordance with one embodiment of the present invention taken along a section line 1-1 of FIG. 2.
Figure 2:
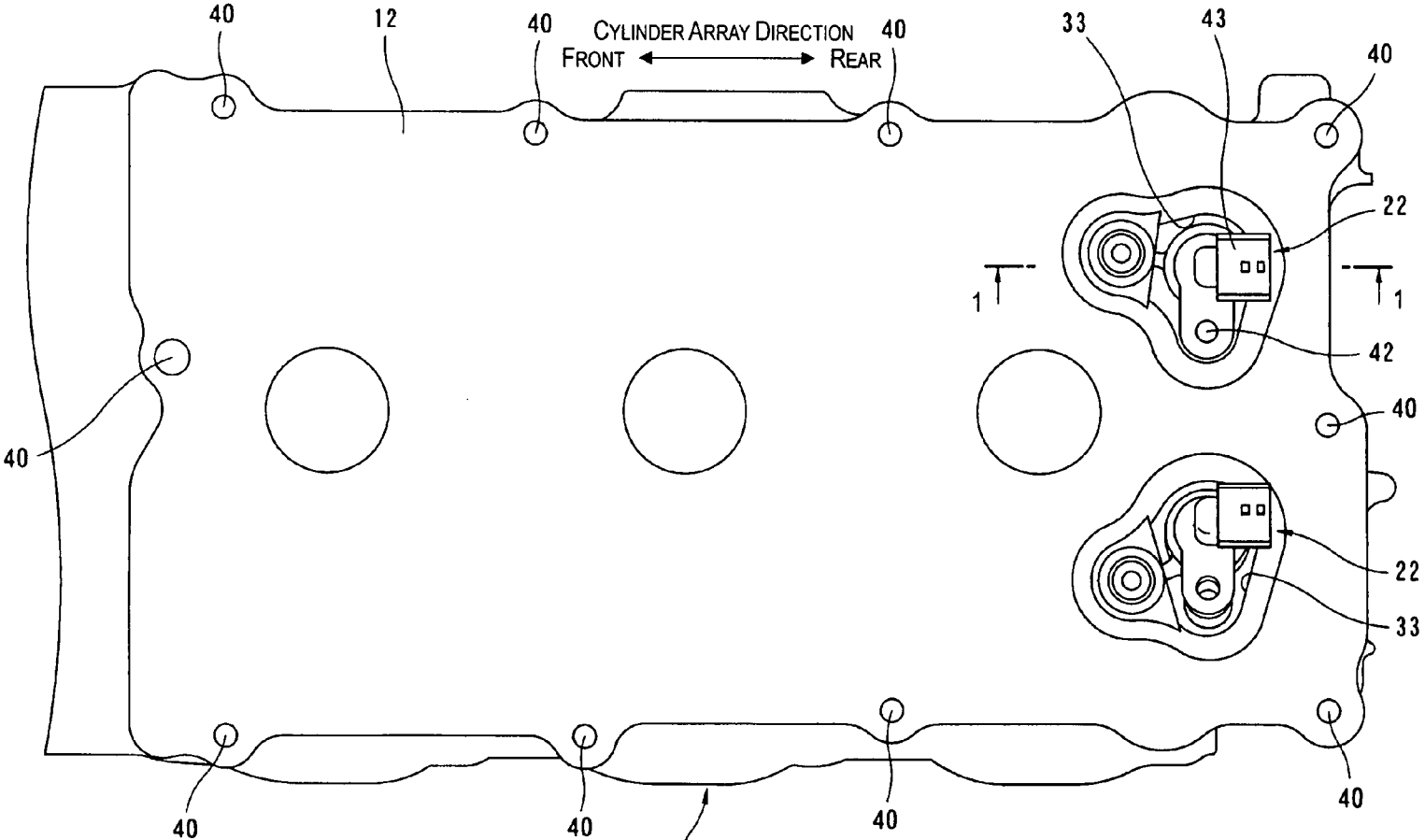
FIG. 2 is a top plan view of a cylinder head of the internal combustion engine with the cam angle sensor mounting structure in accordance with the embodiment of the present invention.
Figure 3:
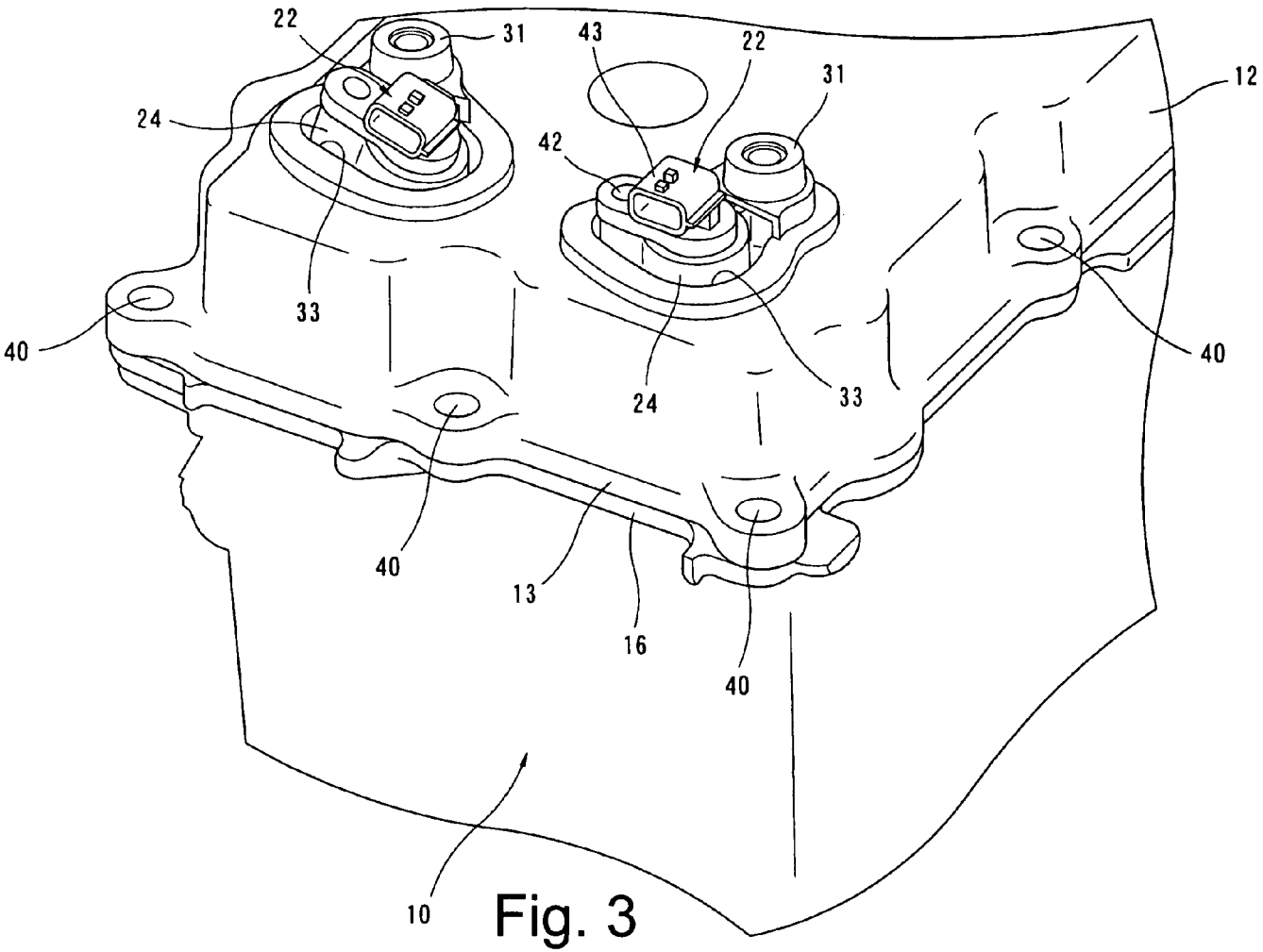
FIG. 3 is a partial perspective view of the cylinder head of the internal combustion engine with the cam angle sensor mounting structure in accordance with the embodiment of the present invention.

A cylinder head 10 made of cast aluminum alloy or the like is provided in each bank of the internal combustion engine. As seen in FIG. 1, the cylinder head 10 has a top opening 11 that opens upward. A head cover 12 (sometimes referred as a rocker cover or cam cover) is attached to the top part of the cylinder head 10 at a plurality of bolt boss portions 40 by bolts to cover the top opening 11. The head cover 12 is integrally formed of lightweight and inexpensive synthetic resin material. The head cover 12 is non-rigidly mounted to the cylinder head 10 with full floating (or semi-floating) mounting structure having good sound vibration characteristics so as not to produce vibration or noise. More specifically, as seen in FIG. 1, a rubber gasket 15 is installed in a gasket channel 14 formed in a bottom opening flange portion 13 at a perimeter of a bottom opening of the head cover 12 such that the entirety of the bottom opening flange portion 13 and the opposing flange-shaped top opening flange portion 16 at a perimeter of the cylinder head 10 is sealed together in a liquid-tight manner with a predetermined gap 17. In other words, the head cover 12 is mounted on the cylinder head 10 via the rubber gasket 15 without the head cover 12 directly contacting the cylinder head 10.

An intake camshaft 19I and an exhaust camshaft 19E (FIG. 5) are rotatably supported by the cylinder head 10 using a plurality of cam brackets (not shown) attached to bearing support positions located adjacent to cam bearings 18 (FIG. 6) of the camshafts 19I and 19E. As is well known, the camshafts 19I and 19E are rotated by a crankshaft via a timing chain or the like such that the intake and exhaust valves open and close in conjunction with the rotation of the camshafts 19I and 19E. Although not shown in the drawings, a variable timing mechanism is preferably provided on both the intake side and the exhaust side to change the phase of the camshafts 19I and 19E relative to the crankshaft rotation angle (CA).

Figure 4:
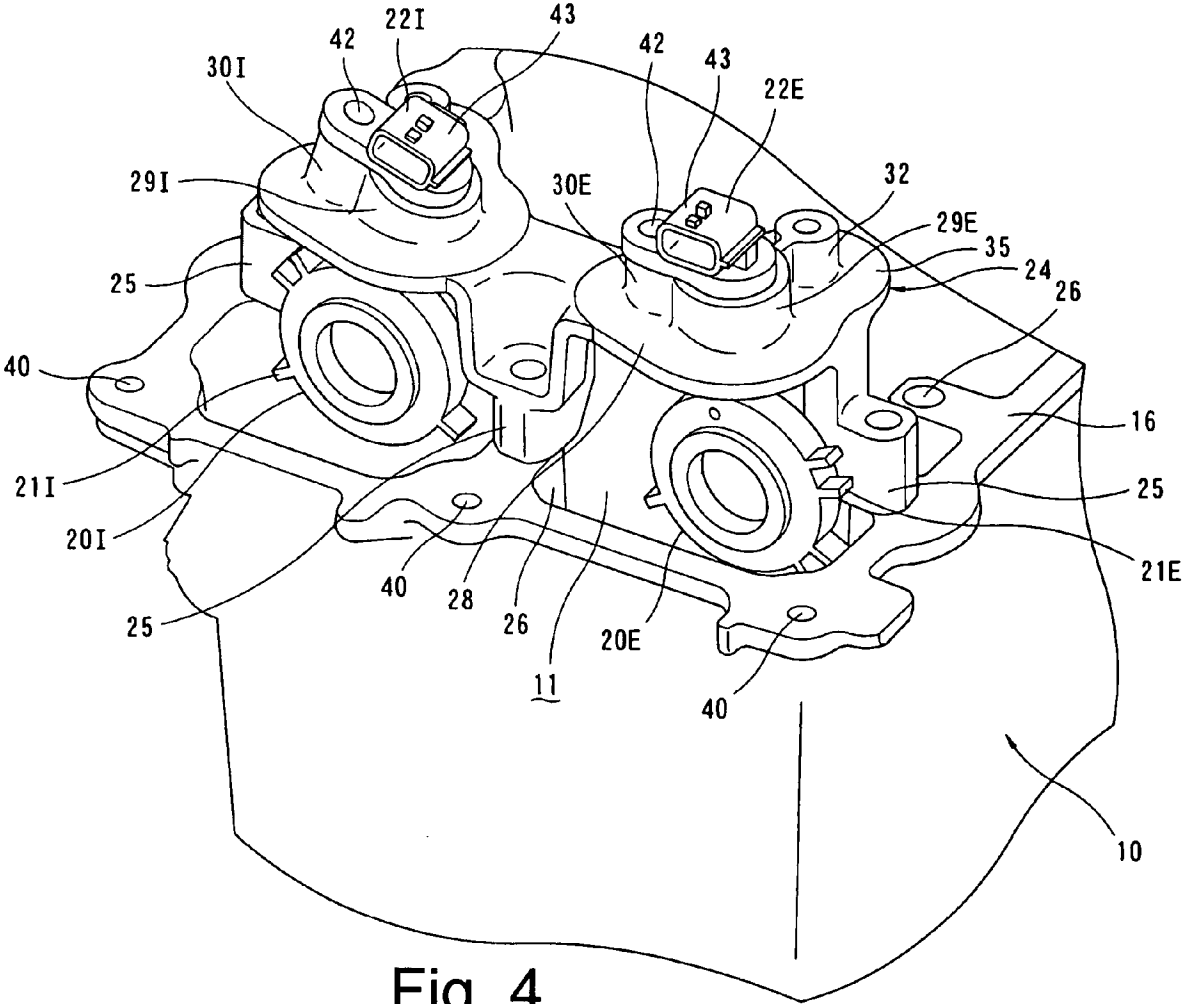
FIG. 4 is a partial perspective view of the cylinder head of the internal combustion engine with the cam angle sensor mounting structure in accordance with the embodiment of the present invention illustrating a state in which a head cover is removed.
Figure 5:
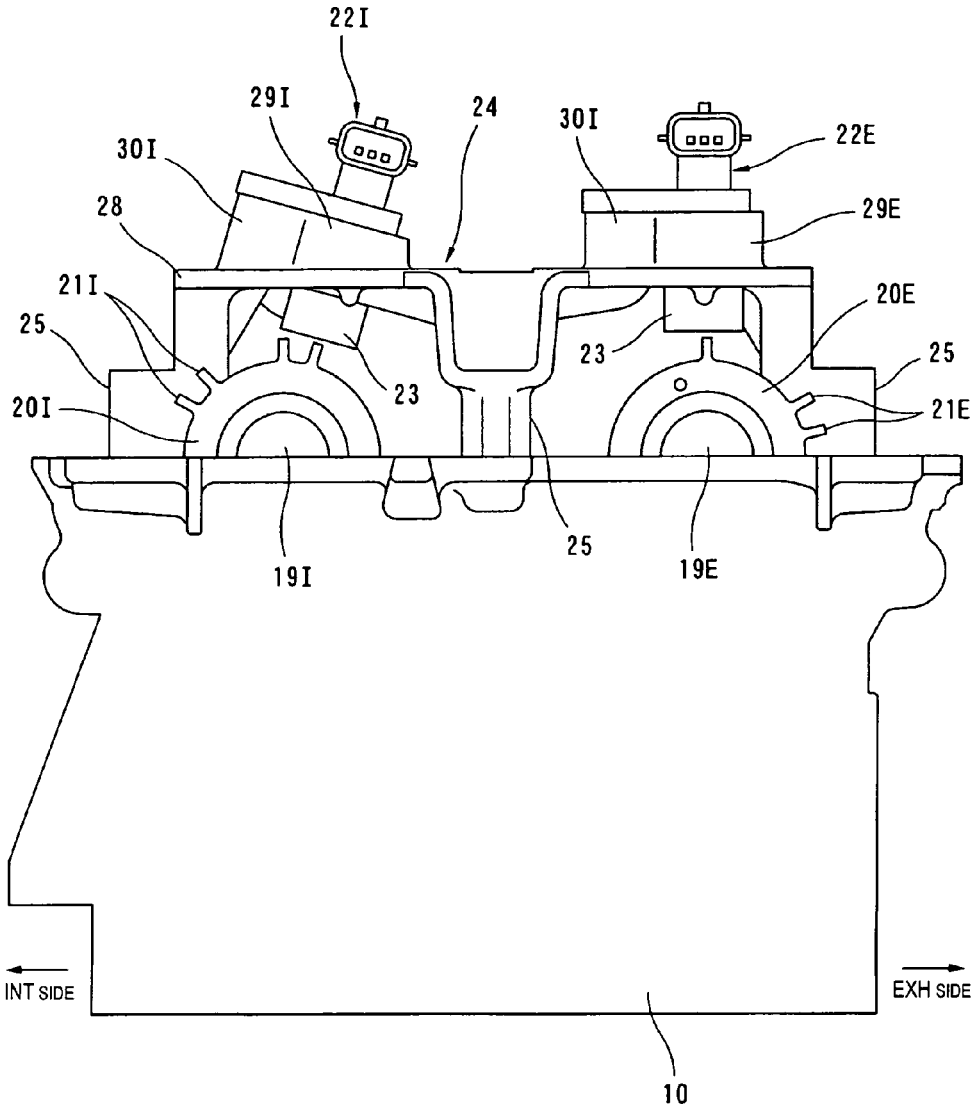
FIG. 5 is a rear side elevational view of the cylinder head of the internal combustion engine with the cam angle sensor mounting structure in accordance with the embodiment of the present invention illustrating a state in which the head cover is removed.

As shown in FIGS. 4 and 5, two signal plates 20I and 20E are provided at the rear ends of the intake and exhaust camshafts 19I and 19E respectively. Several signal projections 21I and 21E are intermittently formed as detection parts in the circumferential direction of each of the signal plates 20I and 20E respectively. Furthermore, two signal sensors 22I and 22E are respectively provided in radial outer direction of each of the signal plates 20I and 20E as shown in FIG. 5. Each of the cam angle sensors 22I and 22E is, for example, a well known PHASE sensor, which is configured and arranged to detect rotation angle of the respective camshaft 19I or 19E by detecting the respective signal projections 21I or 21E of the respective signal plate 20I or 20E via a sensing part 23 provided at the tip end of the respective cam angle sensor 22I or 22E. Although not shown in the drawings, a crank angle sensor is preferably provided to detect the number of rotations of the engine and the crank angle of the crankshaft.

A sensor bracket 24 is a non-cam bracket that is mounted on the top surface at a non-bearing support position of the camshafts 19I and 19E at the rear portion of the cylinder head 10 for mounting the cam angle sensor 22 as shown in FIGS. 4 to 6. The sensor bracket 24 is formed of metal material having the substantially same rigidity and strength as the cylinder head 10, such as aluminum alloy, cast metal and the like. As seen in FIGS. 4 and 7, the sensor bracket 24 includes a plurality of (in this example, thee) generally cylindrical bracket boss portions 25 that are fixedly and rigidly coupled to a plurality of (in this example, three) bolt boss portions 26 of the cylinder head 10 by bolts 27 (only one bolt 27 is shown in FIG. 7) so that the sensor bracket 24 is mounted on the cylinder head 10 with the sensor bracket 24 contacting the cylinder head 10. The bolt boss portions 26 of the cylinder head 10 are formed to extend in an inward direction from the inner wall of the cylinder head 10 to ensure sufficient width of the mounting portion of the rubber gasket 15 along the entirety of the top opening flange portion 16 of the top opening of the cylinder head 10. As seen in FIG. 4, the sensor bracket 24 is provided with a generally flat part 28 connected to the top edge of the bracket boss portions 25. In this embodiment, the sensor bracket 24 is rigidly attached to the top perimeter of the cylinder head 10 at thee locations (first location adjacent to a center portion of the rear wall and second and third locations adjacent to side walls) of the cylinder head 10. The sensor bracket 24 is stably supported above the cylinder head 10 across the rear wall and both side walls of the cylinder head 10 so as to serve as a reinforcing member to reinforce the rear side of the cylinder head 10.

As seen in FIG. 1, the cam angle sensor 22 is mounted in a liquid-tight manner via an O-ring 41 to a respective one of the sensor mounting bosses 29I and 29E from upper direction with the sensing part 23 (tip portion) facing downward and directed at the signal plate 20. As seen in FIG. 4, the cam angle sensor 22 is provided with a flange 42 attached by a bolt to a sensor boss portion 30 of the sensor bracket 24 that is formed adjacent to the sensor mounting boss 29. A connector 43 is provided on the flange 42. The sensing part 23 of the assembled cam sensor 22 is disposed on a plane perpendicular to a center axis of the signal plate 20, and the outer radial direction of the signal plate 20.

As shown in FIG. 1, a boss portion 31 of the head cover 12 is coupled to a boss portion 32 of the sensor bracket 24. Although the boss portion 31 of the head cover 12 and the boss portion 32 of the sensor bracket 24 are illustrated in FIG. 1 as contacting each other, a space is preferably formed between the boss portion 31 and the boss portion 32 when they are coupled together by a bolt so that the head cover 12 is mounted on the sensor bracket 24 in a non-contacting manner. In other words, the head cover 12 is non-rigidly mounted to the sensor bracket 24, so that the head cover 12 can resiliently move slightly in all directions relative to the sensor bracket 24. More specifically, as shown in FIGS. 1 and 4, a top outer flange portion 35 is provided on the outer perimeter of the flat part 28 of the sensor bracket 24. A bracket opening 33 is formed at two locations on the top surface at the rear portions of the head cover 12 (FIGS. 2 and 3), and a gasket channel 36 is formed at the inner opening flange portion 34 of each of the bracket openings 33 (FIG. 1). The top outer flange portion 35 of the sensor bracket 24 and the inner opening flange portion 34 of the head cover 12 are sealed along the entirety of the flange portions ensuring a predetermined gap or space 38 by a rubber gasket 37 installed in the gasket channel 36. In other words, the head cover 12 is mounted on the sensor bracket 24 via the rubber gasket 37 without the head cover 12 directly contacting the sensor bracket 24. Thus, the head cover 12 is mounted in a full floating state above both the cylinder head 10 and the sensor bracket 24.

With the embodiment of the present invention, the cam angle sensor 22 is rigidly mounted on the metal sensor bracket 24, which is mounted on the cylinder head 10 with the sensor bracket 24 directly contacting the cylinder head 10, while the head cover 12 is non-rigidly mounted on the sensor bracket 24 and the cylinder head 10 via the rubber gaskets 15 and 37 without the head cover 12 directly contacting the cylinder head 10 and the sensor bracket 24. The head cover 12 is made of lightweight and inexpensive synthetic resin, and the mounting structure for the cam angle sensor 22 is a full floating soft mounting structure having excellent sound vibration characteristics. Thus, the cam angle sensor 22 is held stably and detection precision is improved through the sensor bracket 24, and the sound vibration characteristics are improved, weight and the cost are reduced through the synthetic resin of the head cover 12 with the non-rigid mounting structure.

Since the sensor mounting boss 29 of the sensor bracket 24 is disposed in the outer radial direction of the signal plate 20, and a circumferential direction detection method is used, superior detection precision is attained compared to when an axial direction detection method is used. Since the cam angle sensor 22 can be inserted from upward direction toward downward direction in the sensor mounting boss 29 of the sensor bracket 24, the sensing part 23 faces downward, thereby providing easy mounting and easy maintenance of the cam angle sensor 22, avoiding contamination of the sensing part 23 by foreign matter, and thus, avoiding soiling and damage of the cam angle sensor 22 by foreign matter.

The entirety of the top opening flange portion 16 of the cylinder head 10 and the bottom opening flange portion 13 of the head cover 12 are sealed by a closed annular type rubber gasket 15. An excellent seal is provided since the seal structure has no three-branch paths or three-branch junctions seal connections. The seal structures of the head cover 12 and the sensor bracket 24 via the rubber gasket 37 are similar to the seal structure of the head cover 12 and the cylinder head 10.

As seen in FIG. 5, the sensor mounting boss 29I is inclined relative to the engine vertical axis so as to restrain engine height regulated by engine hood when installed in the vehicle. The same sensor bracket 24 illustrated in FIGS. 1-7 can be used in the other bank of the cylinder head 10 as seen in FIG. 8. Therefore, the number of the types of parts is reduced compared to when different sensor brackets are used for the left and right banks. As seen in FIG. 8, the inclined sensor mounting boss 29I is disposed on the intake side in one bank, and the inclined sensor mounting boss 29E is disposed on the exhaust side in the other bank.

Accordingly, with the embodiment of the present invention, the head cover 12 is made of lightweight and inexpensive synthetic resin, which suppresses vibration noise, by non-rigidly mounting the head cover 12 on the cylinder head 10 and the sensor bracket 24 via the rubber gaskets 15 and 37 without the head cover 12 directly contacting the cylinder head 10 and the sensor bracket 24. Since the cam angle sensor 22 is mounted on the sensor bracket 24, which is rigidly mounted on the cylinder head 10 with the sensor bracket 24 directly contacting the cylinder head 10, the cam angle sensor 22 can be mounted in a rigid state on the cylinder head 10, thus improving detection precision compared to when the cam angle sensor is mounted on the head cover 12 that is soft mounted on the cylinder head 10. Therefore, both improved precision of the cam angle sensor 22 and a compact and lightweight cam angle sensor mounting structure are attained via the use of the head cover 12 made of synthetic resin or the like.

Although in the embodiment explained above the signal plates 20 and the sensor brackets 24 are provided on the rear side of the engine, the signal plates 20 and the sensor brackets 24 can also be provided the front side of the engine instead of the rear side of the engine.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment, the following directional terms "forward, rearward, above, downward, vertical, horizontal, below and transverse" as well as any other similar directional terms refer to those directions of a vehicle equipped with the present invention unless these terms are defined otherwise in the above description. Accordingly, these terms, as utilized to describe the present invention should be interpreted relative to a vehicle equipped with the present invention unless these terms are defined otherwise in the above description.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A cam angle sensor mounting structure comprising:

a cylinder head configured and arranged to rotatably support a camshaft;

a sensor bracket configured and arranged to support a cam angle sensor, and mounted on the cylinder head with the sensor bracket contacting the cylinder head and being a non-cam bracket that is located in a non-bearing support position of the camshaft; and a head cover non-rigidly mounted on the cylinder head and the sensor bracket via at least one gasket to cover a top opening of the cylinder head with a space being formed around the at least one gasket between the head cover and the cylinder head and between the head cover and the sensor bracket.

2. The cam angle sensor mounting structure according to claim 1, wherein the head cover is made of synthetic resin, and the cylinder head and the sensor bracket are made of metal.

3. The cam angle sensor mounting structure according to claim 2, wherein the sensor bracket is further configured and arranged to support the cam angle sensor inserted therein from upward direction such that a sensing part of the cam angle sensor facing downward.

4. The cam angle sensor mounting structure according to claim 3, wherein the cylinder head includes a top opening flange portion extending in a periphery thereof and the head cover includes a bottom opening flange portion extending in a periphery thereof, the top opening flange portion of the cylinder head and the bottom opening flange portion of the head cover are sealed together with a first gasket disposed therebetween, and the head cover further includes a bracket opening having an inner opening flange portion formed in an inner periphery of the bracket opening and the sensor bracket includes a top outer flange portion that is sealed together with the inner opening flange portion of the head cover with a second gasket disposed therebetween.

5. The cam angle sensor mounting structure according to claim 4, wherein the sensor bracket is attached to a top opening flange portion of the cylinder head at a first position adjacent to a center portion of one of rear and front walls of the cylinder head and second and third positions that are adjacent to a pair of side walls of the cylinder head, respectively.

6. The cam angle sensor mounting structure according to claim 5, further comprising an additional sensor bracket configured and arranged to support an additional cam angle sensor, the sensor bracket being coupled to a first bank of the cylinder head and the additional sensor bracket being coupled to a second bank of the cylinder head with the first and second banks being angled relative to a vertical plane disposed longitudinally between the first and second banks.

7. The cam angle sensor mounting structure according to claim 1, wherein the sensor bracket is further configured and arranged to support the cam angle sensor inserted therein from upward direction such that a sensing part of the cam angle sensor facing downward.

8. The cam angle sensor mounting structure according to claim 1, wherein the cylinder head includes a top opening flange portion extending in a periphery thereof and the head cover includes a bottom opening flange portion extending in a periphery thereof, the top opening flange portion of the cylinder head and the bottom opening flange portion of the head cover are sealed together with a first gasket disposed therebetween, and the head cover further includes a bracket opening having an inner opening flange portion formed in an inner periphery of the bracket opening and the sensor bracket includes a top outer flange portion that is sealed together with the inner opening flange portion of the head cover with a second gasket disposed therebetween.

9. The cam angle sensor mounting structure according to claim 1, wherein the sensor bracket is attached to a top opening flange portion of the cylinder head at a first position adjacent to a center portion of one of rear and front walls of the cylinder head and second and third positions that are adjacent to a pair of side walls of the cylinder head, respectively.

10. The cam angle sensor mounting structure according to claim 1, further comprising an additional sensor bracket configured and arranged to support an additional cam angle sensor, the sensor bracket being coupled to a first bank of the cylinder head and the additional sensor bracket being coupled to a second bank of the cylinder head with the first and second banks being angled relative to a vertical plane disposed longitudinally between the first and second banks.

11. A cam angle sensor mounting structure comprising:

camshaft supporting means for rotatably supporting a camshaft of an internal combustion engine;

sensor supporting means for supporting the cam angle sensor while the sensor supporting means is coupled to the camshaft supporting means with the sensor supporting means contacting the camshaft supporting means, the sensor supporting means not including a function for rotatably supporting the camshaft; and covering means for non-rigidly covering a top opening of the camshaft supporting means to provide resilient relative movement between the cover means and the camshaft supporting means and the sensor supporting means while the covering means is mounted on the camshaft supporting means and the sensor supporting means.

* * * * *